US005477258A

United States Patent [19]

Koo

[11] Patent Number: 5,477,258

[45] Date of Patent: Dec. 19, 1995

[54] PRINTING PAPER GUIDING METHOD AND APPARATUS THEREFOR

[75] Inventor: Sang-Heon Koo, Seoul, Rep. of Korea

[73] Assignee: Samsung Electronics Co., Ltd., Kyungki-do, Rep. of Korea

[21] Appl. No.: 329,174

[22] Filed: Oct. 26, 1994

[30] Foreign Application Priority Data

Oct. 28, 1993 [KR] Rep. of Korea ..... 93-22602

[51] Int. Cl.[6] ..... B41J 25/304

[52] U.S. Cl. ..... 347/197; 400/120.16; 347/218

[58] Field of Search ..... 346/76 PH, 138, 346/136; 347/197, 218; 400/120.16, 248, 120 HE

[56] References Cited

U.S. PATENT DOCUMENTS 5,166,705 11/1992 Roh ..... 346/138

5,353,049 10/1994 Ro et al. ..... 346/138

*Primary Examiner*—Huan H. Tran

*Attorney, Agent, or Firm*—Sughrue, Mion, Zinn, Macpeak & Seas

[57] ABSTRACT

A printing paper guiding method and apparatus for a printer whose printing head guides printing paper when the printer performs a printing operation on printing paper. The printing paper guiding apparatus includes a plate spring having a roller installed below the printing head and a shaft formed in a transverse direction and in the center of the printing head so that the printing head can be inclined about the shaft, thereby to enable the printing paper to be smoothly pushed onto a drum and prevent the printing paper from being separated from the drum. As a result, the entire surface of the printing paper can be printed and a poor printing quality can be prevented.

6 Claims, 4 Drawing Sheets

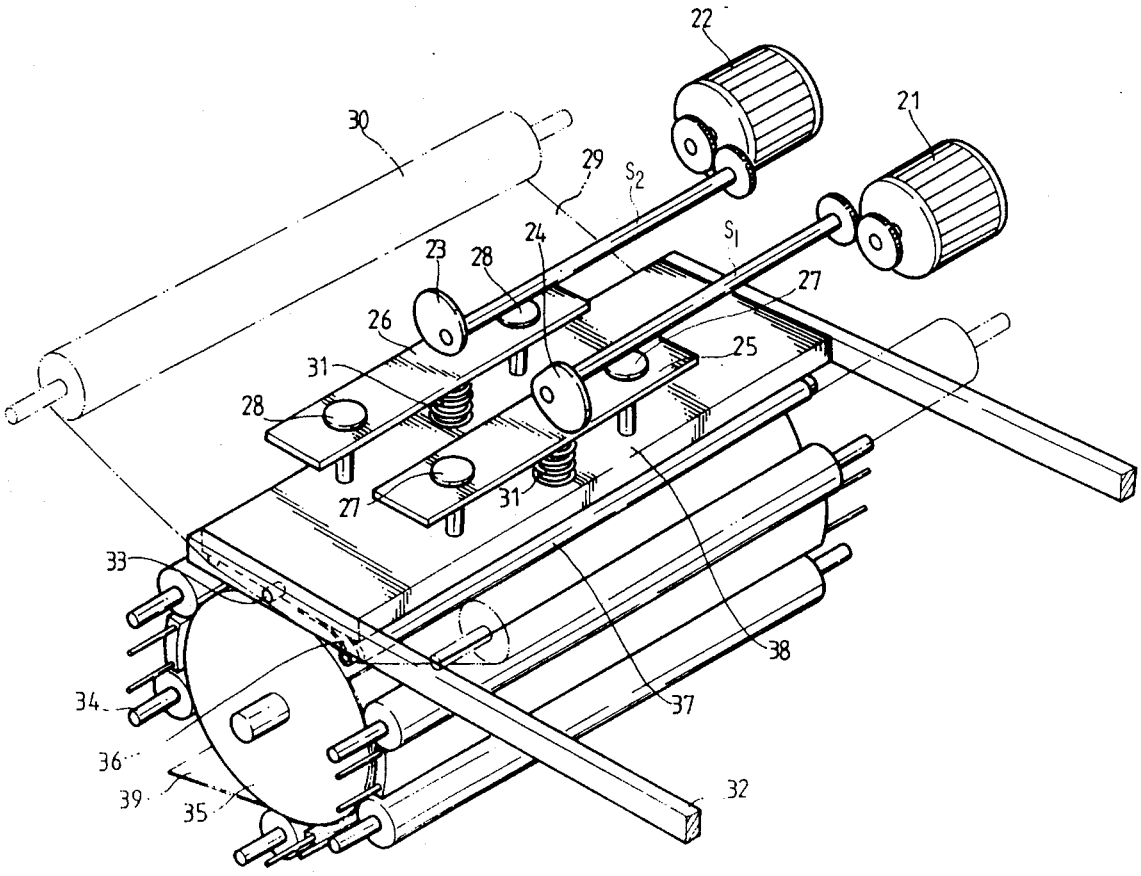

PRINTING PAPER GUIDING METHOD AND APPARATUS THEREFOR

BACKGROUND OF THE INVENTION

1. Field of the Invention

The present invention relates to a printer and, more particularly, to a printing paper guiding method and apparatus for a printer that performs printing over the entire sheet of printing paper as a printing head of the printer pushes the printing paper onto a drum.

2. Description of the Related Art

There are various methods for printing image data on printing paper. For example, a thermal printer performs a printing on printing paper located in the lower portion of an ink film, by employing a thermal print head for generating heat responsive to image data, and the ink film located under the lower portion of the thermal print head. Specifically, a color type thermal transfer printer repeatedly performs printing three times for the divided images such as yellow, magenta and cyan, in order to realize full coloring. Such a thermal transfer printer is an apparatus for sublimating or melting the ink of the ink film to which the heat of a thermal print head is delivered so as to perform a printing on printing paper. The image printed as above is as clear as a photograph taken by an ordinary camera.

Accordingly, the thermal printer can be utilized for various fields. For example, an image is input to a computer by employing an image input device, for example, a scanner, and the input image is modified and synthesized by employing a computer program. Thus, a new image is constituted and outputted again, or imaginary scenes are reproduced and outputted by using a computer graphics method, or an image of an electron microscope is converted into image data which is outputted with a photograph-like image quality. Recently, such precision thermal transfer printers are being used in lieu of photographic printers. Accordingly, the output of such devices should be of nearly the same image quality and form as a photograph from a camera.

FIG. 1 is a side elevation showing a printing operation of a color thermal transfer printer adopting the conventional printing method. A printing paper 9 provided by a paper supply cassette 1 is guided by paper supply rollers 3 and provided between a paper reject/supply roller 2 and a drum 10. The provided paper 9 is pushed onto the drum 10 by a plurality of guide rollers 4 that exist around the drum, and as drum 10 rotates, the leading end of the pushed printing paper 9 reaches an initial printing location 11 where a printing at the lower portion of printing head 8 is performed initially. At this time, the leading end of the printing paper is separated from the drum.

As shown in FIG. 2, when a printing is performed from the leading end of the printing paper by lowering the printing head 8, a problem occurs in that guide rollers 4 cannot push the printing paper 9 onto drum 10 thoroughly. Thus, printing cannot be performed throughout the entire sheet of printing paper, and the printing may be disturbed. As a result, image quality is degraded.

SUMMARY OF THE INVENTION

Accordingly, it is an object of the present invention to provide a printing paper guiding method and apparatus for a printer and which prevent a poor quality printing of the printing paper by smoothly inclining a printing head so as to push the printing paper onto a drum when the printing paper reaches an initial printing location by means of a guide roller and preventing the printing paper from separating from the drum, and by performing a printing by smoothly pushing the leading end of the printing paper onto the drum when the entire surface of the printing paper is printed, so that a clear image is formed on the printing paper.

To accomplish the above object, there is provided a printing paper guiding apparatus of a printer that transfers printing paper to a drum so as to perform printing by pressing an ink film and a printing head onto the printing paper being transferred. The printing paper guiding apparatus comprises first means for inclining the printing head toward an inverse direction of the rotation direction of the drum, and second means for inclining said printing head toward the rotation direction of the drum and sequentially pushing the leading end of the printing paper onto the drum as the printing head inclines.

The above-mentioned first inclining means comprises rotation shaft installed in the printing head so as to rotatably support the printing head, an elevator for supporting the rotation shaft so as to elevate/lower the printing head to perform a printing, and a first cam for selectively pressing one side of the printing head centering on the rotation shaft and wherein the second inclining means comprises the rotation shaft installed in the printing head so as to rotatably support the printing head, the elevator for supporting the rotation shaft, and a second cam for selectively pressing an opposite side of the printing head with respect to the rotation shaft.

To accomplish the above object, there is provided a printing paper guiding method for a printer that performs a printing on the printing paper transferred between a drum and a guide roller by means of pressing a printing head against the printing paper, the method comprising the steps of:

inclining the printing head when the leading end of the printing paper is transferred between the drum and the printing portion of the printing head so that the printing head presses the rear portion of the leading end of the printing paper toward the inserting direction of the printing paper; and inclining the printing head toward a direction opposite to the inserting direction of the printing paper so that the leading end of the printing paper is pushed onto the drum when the leading end of the printing paper passes through an initial printing location.

BRIEF DESCRIPTION OF THE DRAWINGS

The above objects and other advantages of the present invention will become more apparent by describing in detail a preferred embodiment thereof with reference to the accompanying drawings, in which.

DETAILED DESCRIPTION OF THE PREFERRED EMBODIMENT

Figure 1:
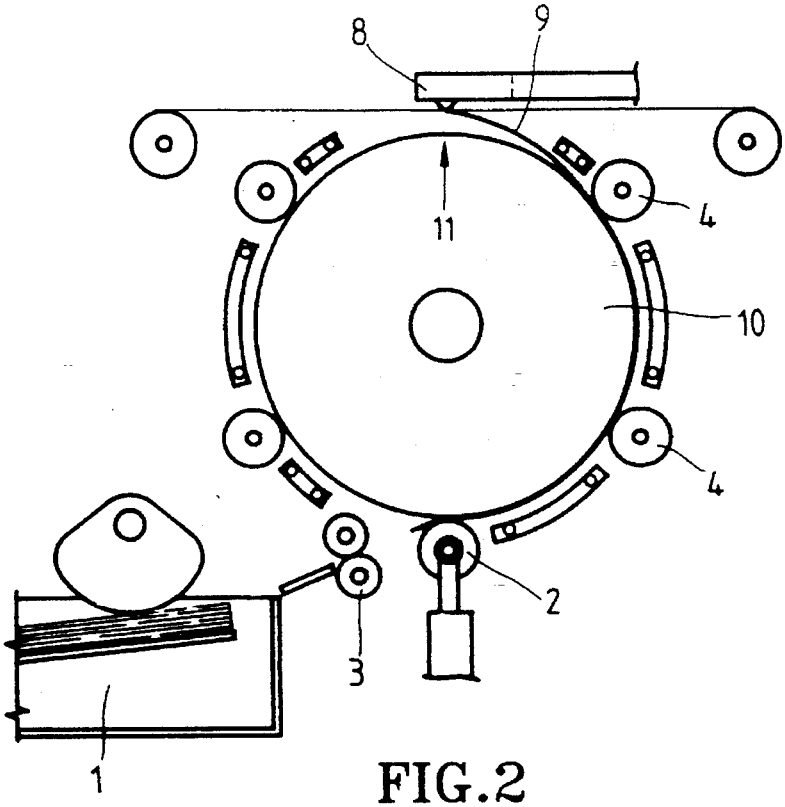
FIG. 1 is a side elevation showing the state where the leading end of printing paper is guided by a conventional printing paper guiding apparatus of the printer.
Figure 2:
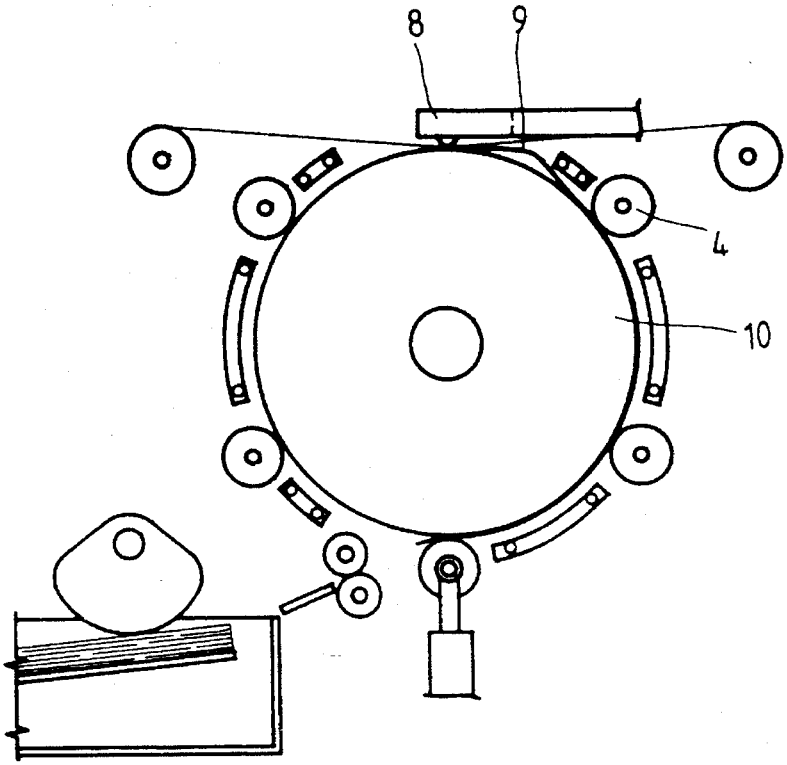
FIG. 2 is a side elevation showing the state where the leading end of printing paper is guided and printed by employing a conventional printing paper guiding apparatus of the printer.
Figure 3:
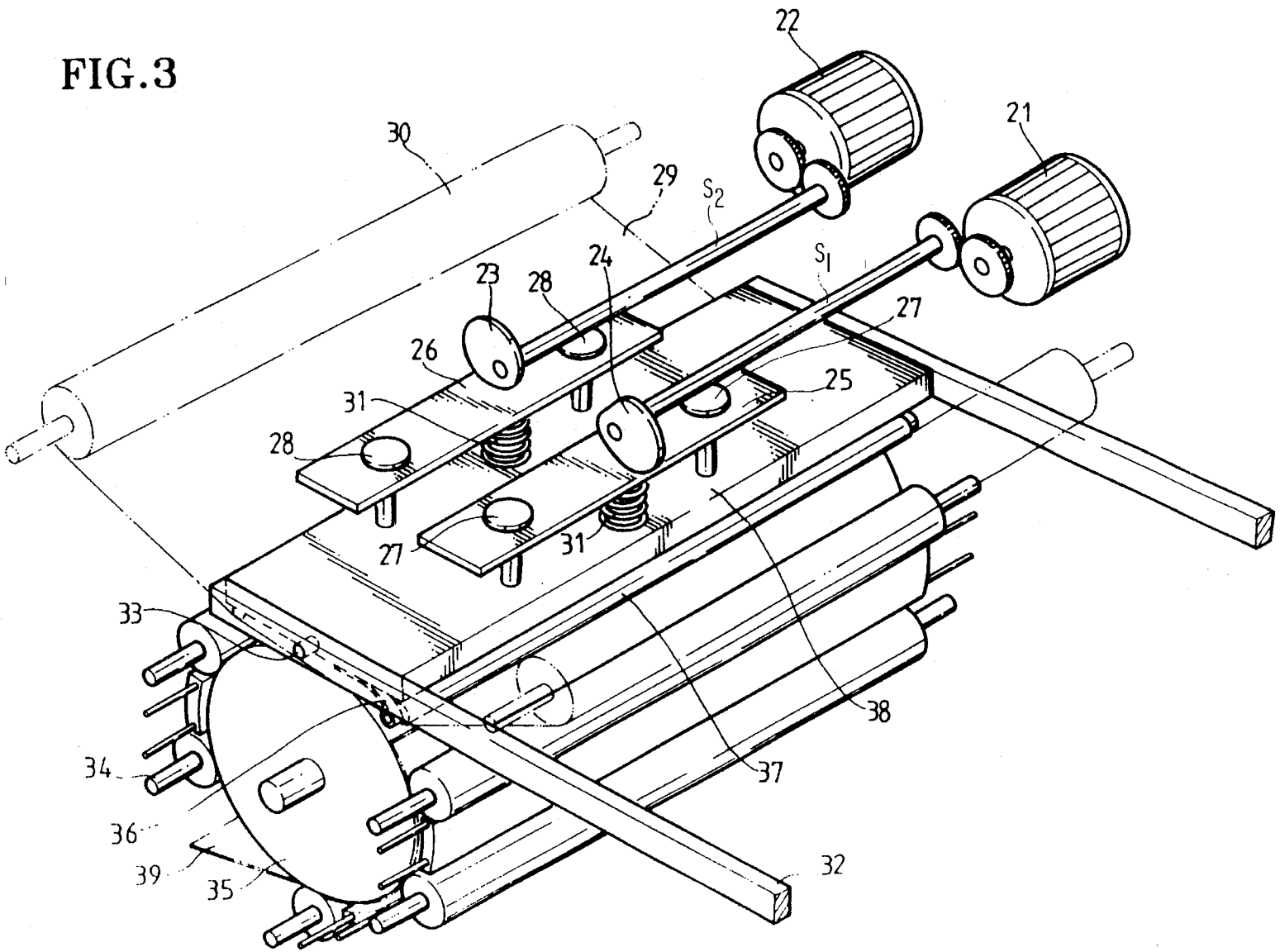
FIG. 3 is a perspective view illustrating a printing paper guiding apparatus of a printer of the present invention.

FIG. 3 is a perspective view illustrating a printing paper guiding apparatus of a printer of the present invention. As shown in FIG. 3, supporting pins 27 and 28 are installed in two rows in a transverse direction on the upper surface of a printing head 38 that generates heat responsive to image data. Supporting plates 25 and 26 are respectively installed to be combined with the two rows of supporting pins 27 and 28. Springs 31 are respectively installed between the supporting plates 25 and 26 and the printing head 38. Cams 24 and 23 connected to respective shafts $S_1$ and $S_2$ driven by motors 21 and 22, respectively, are installed so as to engage the upper surfaces of supporting plates 25 and 26, respectively.

A rotation shaft 33 is installed in the center of printing head 38 so that the printing head can rotate or pivot about the rotation shaft 33, and is supported by a printing head elevator 32 which elevates the printing head as necessary.

A plate spring 36 for resiliently pushing an ink film 29 and a printing paper 39 onto a drum 35 is installed at the bottom surface of printing head 38. A roller 37 is installed at an end of the plate spring 36. The ink film 29, bearing ink that can be sublimated by heat and deposited, is loaded at the bottom surfaces of roller 37 and printing head 38, respectively. The ink being sublimated is attached to printing paper 39 that is located below ink film 29 so that a printing can be performed. In addition, the drum 35 for transferring printing paper is installed below printing paper 39, and a plurality of guide rollers 34 for pushing the printing paper onto the drum 35 and guiding the pushed paper are installed around the drum 35.

A printing paper guiding apparatus of a printer of the present invention operates as follows.

Figure 4:
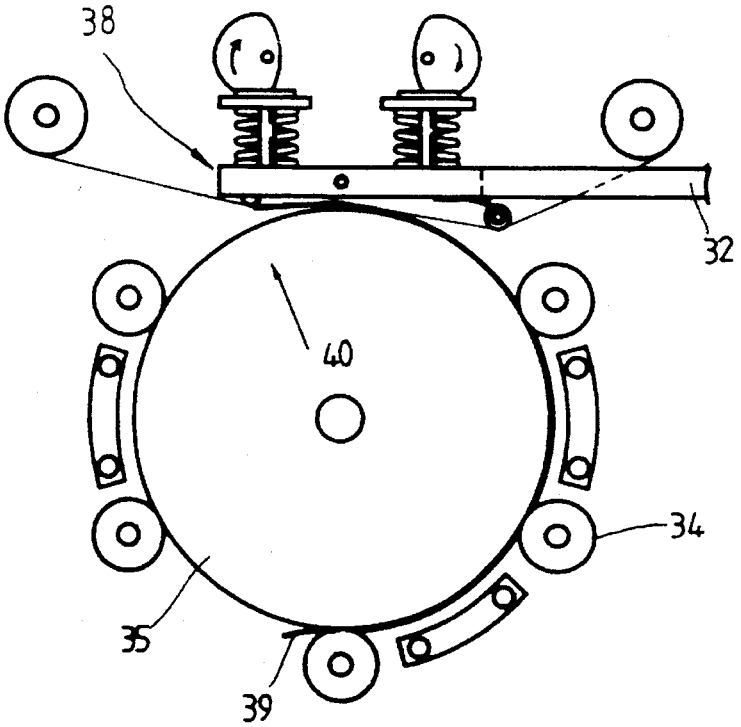
FIG. 4 is a side elevation showing the state where printing paper is transferred to a printing paper guiding apparatus of a printer of the present invention.

FIG. 4 is a side elevation showing the state where printing paper is transferred to a printing paper guiding apparatus of a printer of the present invention. The leading end of the printing paper 39 supplied from a printing paper cassette is sensed by a sensor (not shown), and is pushed onto the drum 35 by the plurality of guide rollers 34 installed around drum 35, and guided to an initial printing location 40 below the printing head 38, where a printing starts. At this time, the printing head 38 is maintained in a horizontal state, and elevator 32 is lowered to perform printing.

Figure 5:
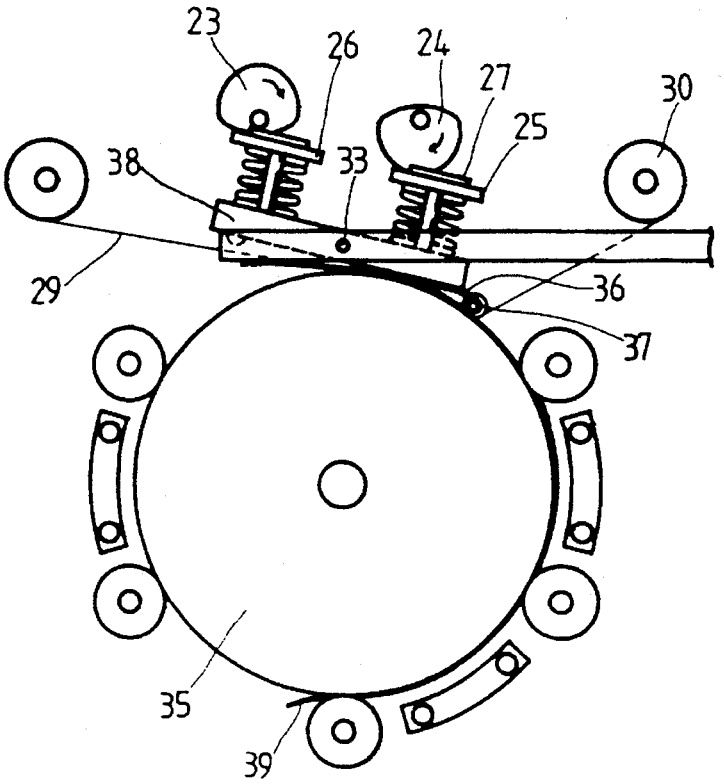
FIG. 5 is a side elevation showing the state where a rear portion of the leading end of the printing paper is pushed onto a drum by employing a printing paper guiding apparatus of the present invention.

FIG. 5 is a side elevation showing the state where a rear portion of the leading end of the printing paper (i.e., a portion somewhat removed from the leading edge of the printing paper) is pushed onto the drum 35 by employing a printing paper guiding apparatus of the present invention. As can be seen, first cam 24 rotates so that the long radius of first cam 24 can engage the first supporting plate 25, and second cam 23 rotates so that the short radius of second cam 23 can engage the second supporting plate 26. Thus, printing head 38 inclines toward the inserting direction of the printing paper 39. At this time, the ink film 29 and the printing paper 39 are pushed onto the drum 35 by employing the roller 37 installed at plate spring 36 attached below the printing head 38.

Figure 6:
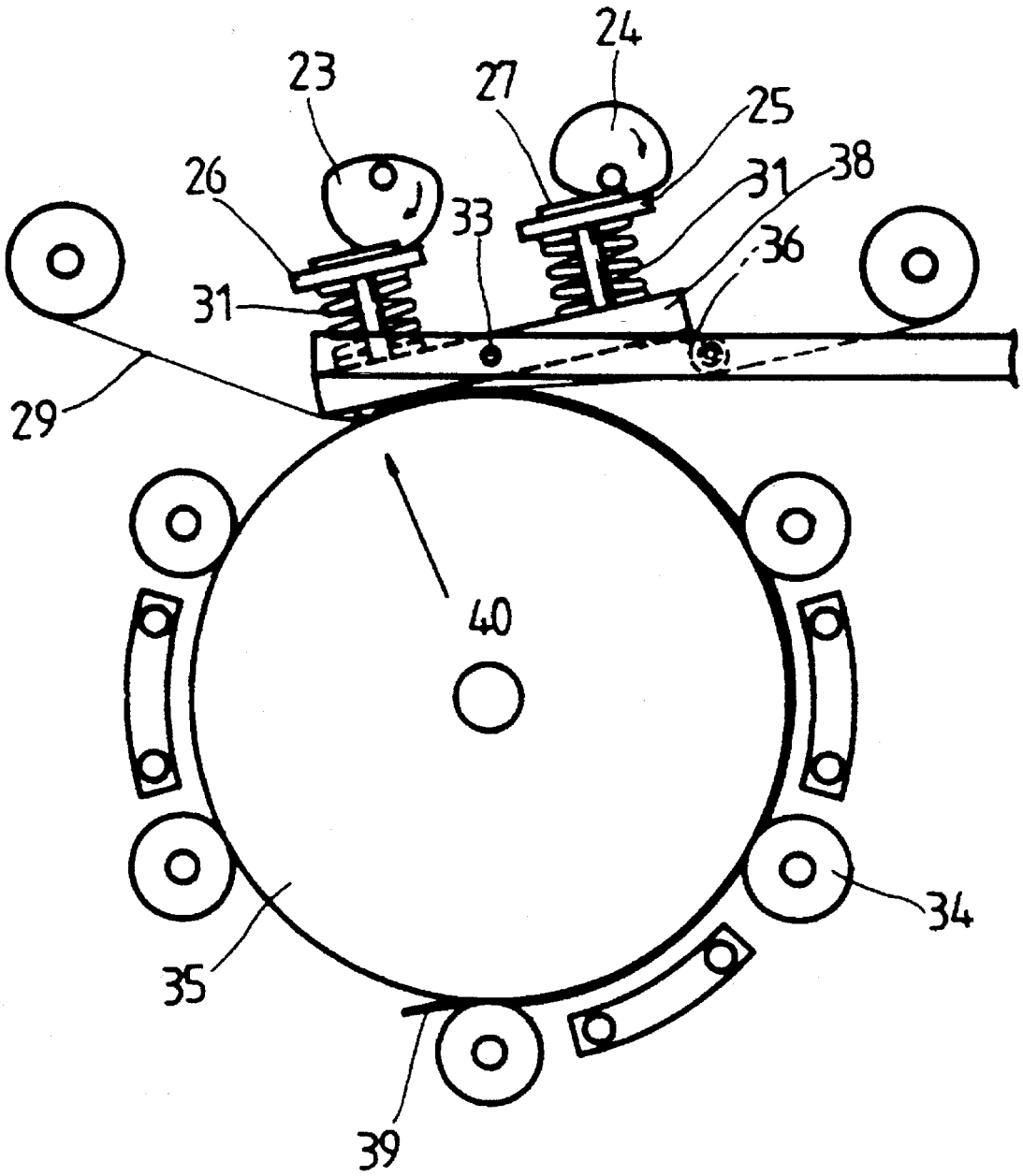
FIG. 6 is a side elevation showing the state where printing paper is pushed onto a drum by employing a printing paper guiding apparatus of a printer of the present invention.

FIG. 6 is a side elevation showing the state where printing paper is pushed onto the drum 35 by employing a printing paper guiding apparatus of a printer of the present invention. As can be seen, first cam 24 rotates so that the short radius of the first cam 24 can engage the first supporting plate 25, and the long radius of the second cam 23 can engage the second supporting plate 26. Thus, the printing head 38 inclines toward the opposite direction of the inserting direction of printing paper and smoothly pushes ink film 29 and the leading end of printing paper 39 guided to the initial printing location 40 onto the drum 35 assisted by the spring 31. At the same time, the printing head 38 presses the printing paper 39 and the ink film 29 and starts printing from the leading end of the printing paper 39.

As described above, the printing head smoothly inclines so as to smoothly push the printing paper onto the drum that reaches an initial printing location. Thus, a poor printing quality owing to separation of the printing paper from the drum can be prevented. Also, the leading end of the printing paper is smoothly pushed onto the drum when the entire surface of the printing paper is printed. As a result, the entire surface of the printing paper can be printed with a clear image quality.

It is contemplated that numerous modifications may be made to the printing paper guiding method and apparatus for a printer of the present invention without departing from the spirit and scope of the invention as defined in the following claims.

What is claimed is:

1. A printing paper guiding method for a printer that performs a printing on a printing paper transferred between a drum and a guide roller by means of pressing a printing head against the printing paper, said method comprising the steps of:

inclining the printing head when a leading end of the printing paper is transferred between the drum and a printing portion of the printing head so that the printing head presses a rear portion of the leading end of the printing paper toward an inserting direction of the printing paper; and inclining the printing head toward a direction opposite to the inserting direction of the printing paper so that the leading end of the printing paper is pushed onto the drum when the leading end of the printing paper passes through an initial printing location.

2. A printing paper guiding apparatus of a printer, the printer including a drum having a rotation direction, a printing head and an ink film, so as to transfer printing paper to the drum thereby to perform a printing by pressing the ink film and the printing head onto the printing paper being transferred, said printing paper guiding apparatus comprising:

first means for inclining said printing head toward an inverse direction of the rotation direction of the drum; and second means for inclining said printing head toward the rotation direction of the drum and sequentially pushing a leading end of the printing paper onto the drum as the printing head inclines.

3. The printing paper guiding apparatus according to claim 2, wherein said first inclining means comprises a rotation shaft installed in the printing head so as to rotatably support the printing head, an elevator for supporting the rotation shaft so as to elevate and lower the printing head to perform a printing, and a first cam for selectively pressing one side of the printing head centering on said rotation shaft, and wherein said second inclining means comprises said rotation shaft installed in the printing head so as to rotatably support the printing head, said elevator for supporting said rotation shaft, and a second cam for selectively pressing an opposite side of said printing head with respect to said rotation shaft.

4. The printing paper guiding apparatus according to claim 3, further comprising supporting pins installed on an upper surface of the printing head in two rows in a transverse direction, supporting plates respectively combined with each row of said supporting pins and which are respectively engaged by said first and second cams, and a spring provided between each of the supporting plates and the printing head, thereby to smoothly press said printing head onto the drum.

5. The printing paper guiding apparatus according to claim 2, wherein the printing head comprises at least one resilient guiding member installed below the printing head and which provides a resilience so as to push the printing paper and the ink film onto the drum and guide the same.

6. The printing paper guiding apparatus according to claim 5, wherein the resilient guiding member comprises a roller installed at a leading end of the resilient guiding member and which reduces friction generated between the resilient guiding member and the ink film.

* * * * *